US008318307B2

(12) United States Patent
Byrd et al.

(10) Patent No.: US 8,318,307 B2
(45) **Date of Patent: *Nov. 27, 2012**

(54) ELECTROCHEMICAL DEPOSITIONS APPLIED TO NANOTECHNOLOGY COMPOSITES

(75) Inventors: Norman R. Byrd, Villa Park, CA (US); Stephen C. Amundson, Huntington Beach, CA (US); Robert H. Coker, III, Whitter, CA (US)

(73) Assignee: The Boeing Company, Chicago, IL (US)

( * ) Notice: Subject to any disclaimer, the term of this patent is extended or adjusted under 35 U.S.C. 154(b) by 1607 days.

This patent is subject to a terminal disclaimer.

(21) Appl. No.: 11/691,022

(22) Filed: Mar. 26, 2007

(65) Prior Publication Data

US 2008/0053831 A1 Mar. 6, 2008

Related U.S. Application Data

(62) Division of application No. 10/676,860, filed on Sep. 30, 2003, now Pat. No. 7,195,701.

(51) Int. Cl.

| | |
|---|---|
| ***B41M 5/20*** | (2006.01) |
| ***C25D 11/00*** | (2006.01) |
| ***D04H 1/00*** | (2006.01) |
| ***B32B 17/10*** | (2006.01) |
| ***B32B 9/04*** | (2006.01) |

(52) U.S. Cl. ..... 428/408; 428/292.1; 428/411.1; 205/50; 205/317

(58) Field of Classification Search ..... None
See application file for complete search history.

(56) References Cited

U.S. PATENT DOCUMENTS

| | | | | |
|---|---|---|---|---|
| 3,926,761 | A | 12/1975 | Sera et al. | |
| 4,272,346 | A * | 6/1981 | Jakubowski et al. | 428/367 |
| 4,341,889 | A | 7/1982 | Deichert et al. | |
| 4,405,427 | A | 9/1983 | Byrd | |
| 4,480,088 | A | 10/1984 | Pike | |
| 4,588,838 | A | 5/1986 | Byrd | |
| 4,614,696 | A * | 9/1986 | Ito et al. | 429/222 |
| 4,659,444 | A | 4/1987 | Iwata et al. | |
| 4,664,768 | A | 5/1987 | Scala et al. | |
| 4,724,062 | A | 2/1988 | Naarmann et al. | |
| 4,738,757 | A | 4/1988 | Naarmann | |

(Continued)

FOREIGN PATENT DOCUMENTS

DE 37 00 811 7/1988

(Continued)

OTHER PUBLICATIONS

Tsubokawa et al., "Surface Grafting of Polymers onto Carbon Thin Film," *Journal of Applied Polymer Science*, vol. 58, 1995, pp. 1221-1227.

(Continued)

*Primary Examiner* — Camie Thompson
(74) *Attorney, Agent, or Firm* — Alston & Bird LLP

(57) ABSTRACT

A method of improving the material properties of a composite by electrodepositing various polymers, organic compounds or inorganic compounds onto each individual carbon (graphite) fiber strand, whether individual fiber or as a fabric to form an homogeneous chemically-bonded composite as opposed to the formation of a heterogeneous, non-chemically bonded composite. Thus, electrodeposition forms a unique discrete interface at the molecular layer (nanolayer) between the reinforcement (fiber) and the matrix (resin) over as opposed to any previous resin infusion process.

16 Claims, 10 Drawing Sheets

A = Supply spool of graphite fiber or cloth.
B = Graphite pulley used as electrode.
C = Teflon pulleys.
D = Coating bath.
E = Wash bath.
F = Heaters used to activate fiber and subsequently cure or dry fiber/resin composite.
G = Graphite cathode.

Schematic of Continuous Electrodeposition onto Graphite Fibers

U.S. PATENT DOCUMENTS

| | | | | |
|---|---|---|---|---|
| 4,739,115 | A | 4/1988 | Byrd et al. | |
| 4,749,451 | A | 6/1988 | Naarmann | |
| 5,126,017 | A | 6/1992 | Nakama et al. | |
| 5,238,542 | A | 8/1993 | Bell et al. | |
| 5,358,747 | A * | 10/1994 | Balaba et al. | 427/387 |
| 5,844,053 | A | 12/1998 | Nishida | |
| 6,033,545 | A | 3/2000 | Kaylo et al. | |
| 6,797,795 | B2 | 9/2004 | Byrd | |
| 7,854,788 | B2 * | 12/2010 | Byrd et al. | 95/45 |
| 2004/0091711 | A1 * | 5/2004 | Mukasa et al. | 428/408 |
| 2005/0161337 | A1 * | 7/2005 | Byrd et al. | 205/159 |

FOREIGN PATENT DOCUMENTS

| | | |
|---|---|---|
| EP | 0 374 680 | 6/1990 |
| GB | 1 205 852 | 9/1970 |
| GB | 1 404 290 | 8/1975 |
| WO | WO 2005/033373 | 4/2005 |

OTHER PUBLICATIONS

Delamar et al., "Modification of Carbon Fiber Surfaces by Electrochemical Reduction of Aryl Diazonium Salts: Application to Carbon Epoxy Composites," *Carbon*, vol. 35, No. 6, 1997, pp. 801-807.

Reichenbacher et al., "Intermediates in Anodic Oxidation of Carboxylates. Chronopotentiometry," *Journal of the American Chemical Society*, vol. 90, No. 13, Jun. 1968, pp. 3432-3436.

Andrieux et al., "Derivatization of Carbon Surfaces by Anodic Oxidation of Arylacetates. Electrochemical Manipulation of the Grafted Films," *Journal of the American Chemical Society*, vol. 119, 1997, pp. 4292-4300.

Buttry et al., "Immobilization of amines at carbon fiber surfaces," *Carbon*, vol. 37, 1999, pp. 1929-1940.

Miller et al., "Electrode Surface Modification via Polymer Adsorption," *Journal of the American Chemical Society*, vol. 100, No. 2, Jan. 1978, pp. 639-640.

Downard, Alison, "Electrochemically Assisted Covalent Modification of Carbon Electrodes," *Electroanalysis*, vol. 12, No. 14, 2000, pp. 1085-1096.

Pierson, H.O., "Applications of Carbon Fibers," *Chapter 9 from Handbook of Carbon, Graphite, Diamond and Fullerenes—Properties, Processing and Applications*, 1993, pp. 198-225.

Database WPI Section Ch, Week 200612 Derwent Publications Ltd., London, GB; AN 2002-011675 XP002390849 & CN 1 160 488C; Changchun Applied Chem Inst Chinese Acad; Aug. 4, 2004.

PCT Search Report and Written Opinion for PCT/US2006/001610 dated Aug. 8, 2006.

* cited by examiner

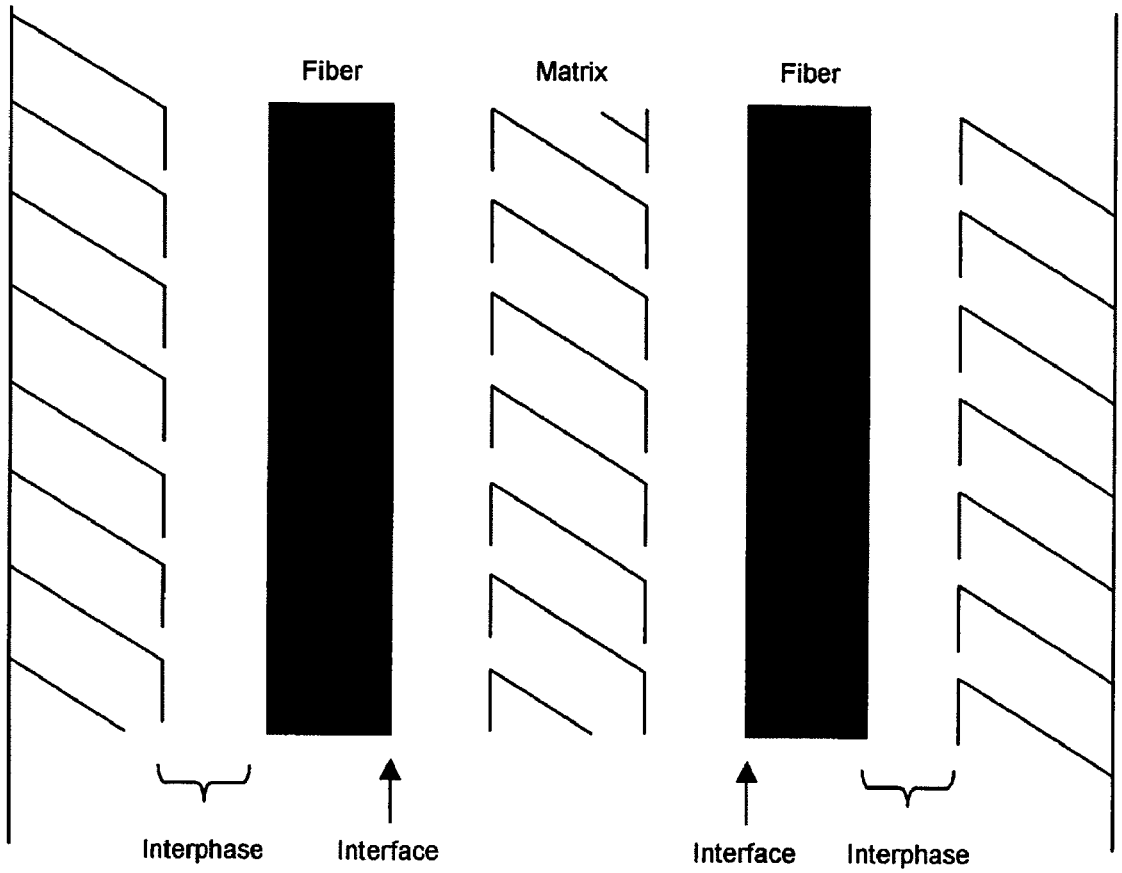
Figure 1. Fiber-Matrix Interface/Interphase in Fibrous Composite Material

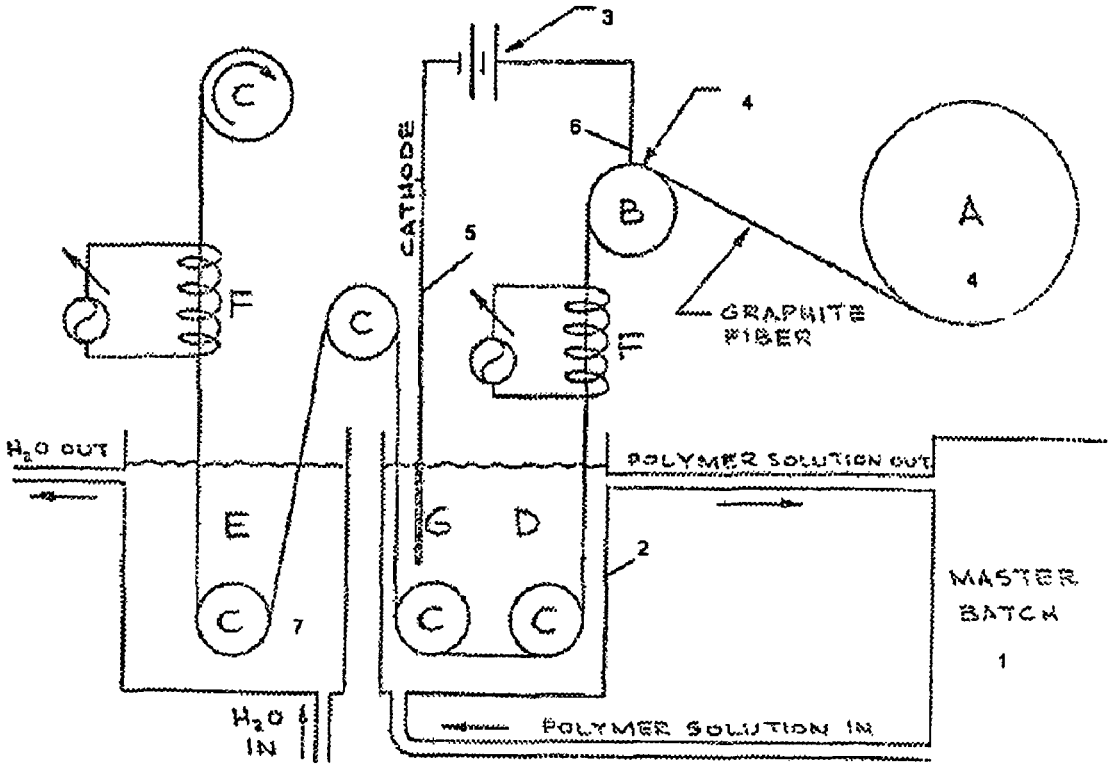
A = Supply spool of graphite fiber or cloth.
B = Graphite pulley used as electrode.
C = Teflon pulleys.
D = Coating bath.
E = Wash bath.
F = Heaters used to activate fiber and subsequently cure or dry fiber/resin composite.
G = Graphite cathode.
Figure 2. Schematic of Continuous Electrodeposition onto Graphite Fibers

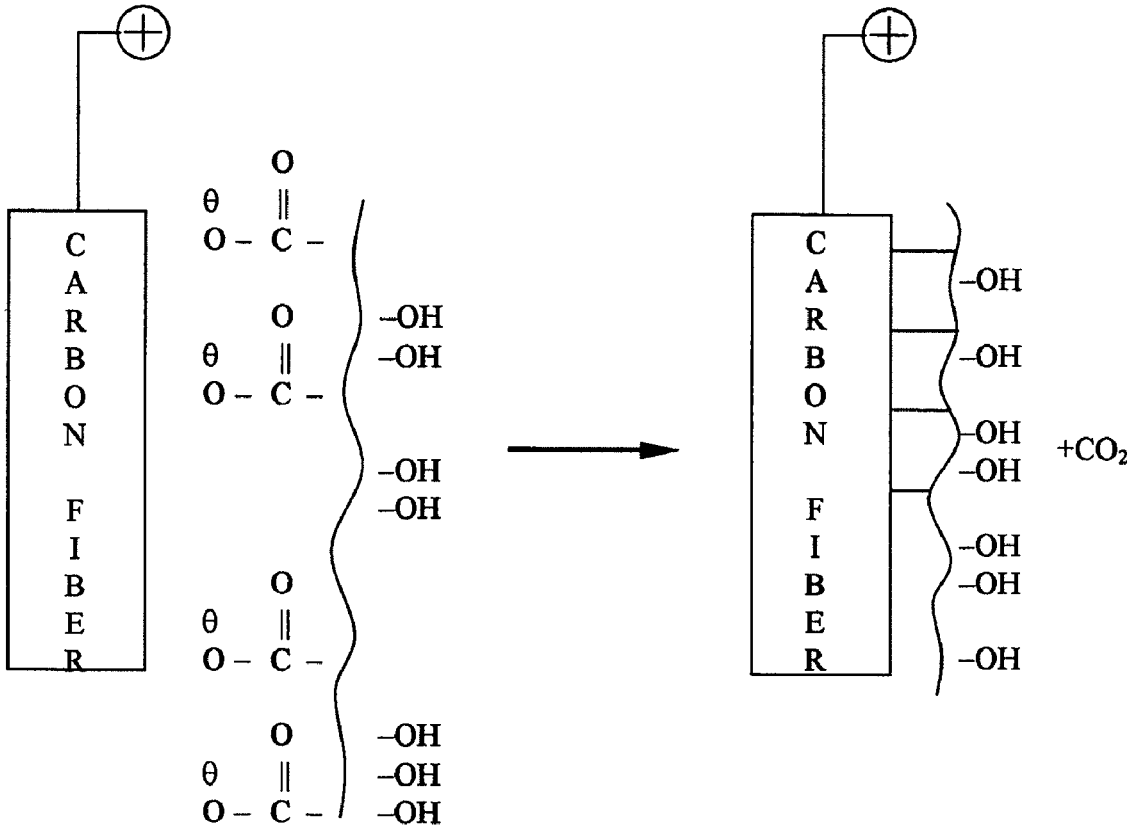
Figure 3. Electrodeposition of Carboxymethylcellulose Onto Carbon Fiber
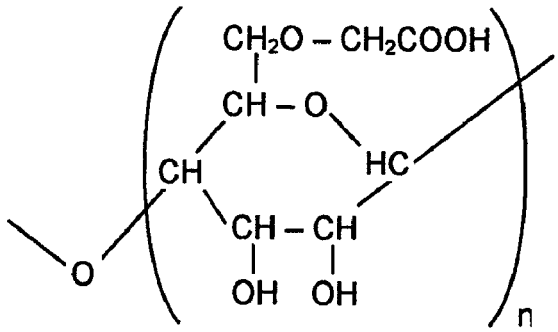
Figure 4. Carboxymethylcellulose

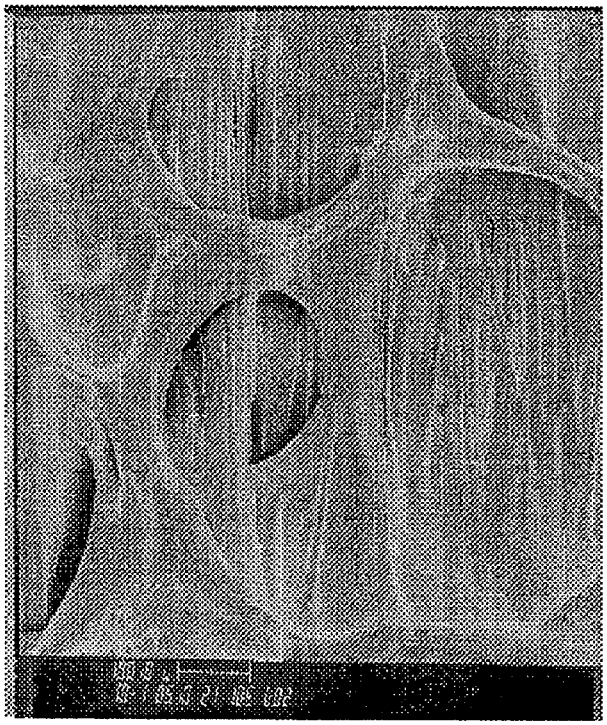
Figure 5. 100X of Electrodeposited CMC on Carbon Fibers
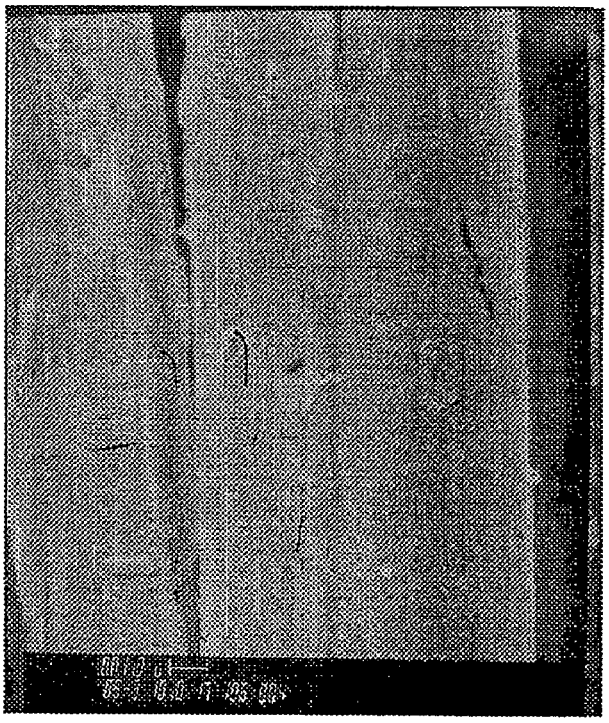
Figure 6. 5000X of Electrodeposited CMC and Washed With NaOH Solution

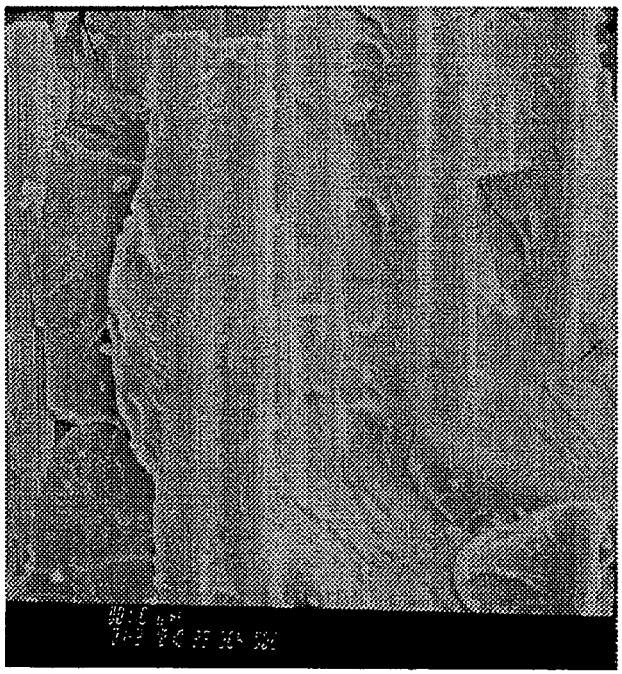
Figure 7. CMC Electrodeposited, Embedded in Epoxy and Fractured – 1000X
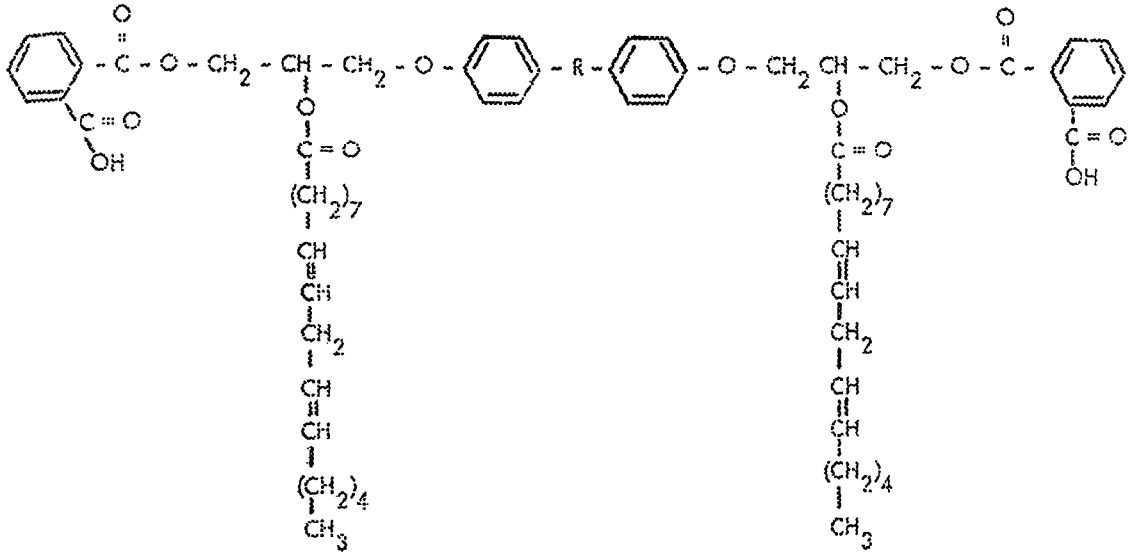
Figure 12. Generalized Structure of DX-16

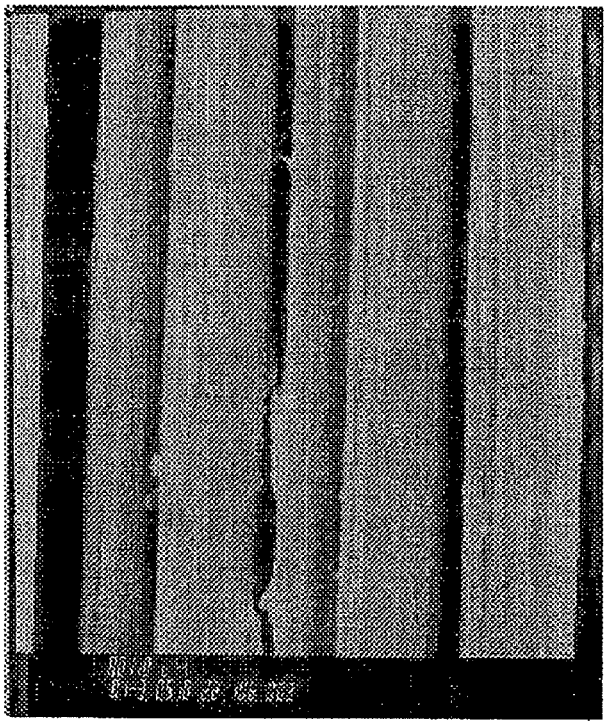
Figure 9. Styrene/Maleic Di-acid Electrodeposited on Unsized Fibers – 1000X
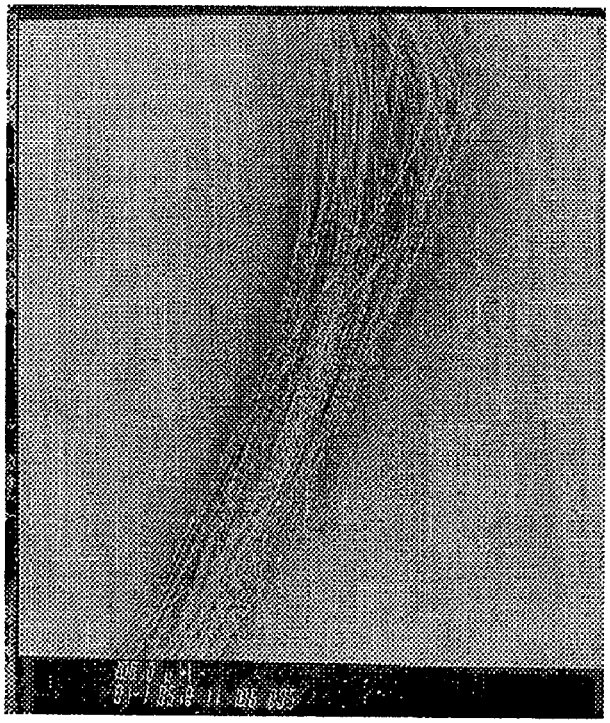
Figure 8. Styrene/Maleic Di-acid Electrodeposited on Unsized Fibers – 10X

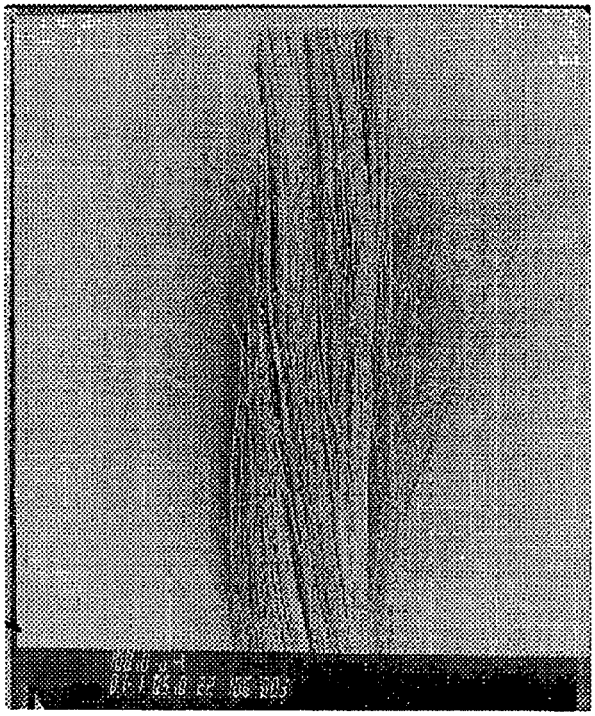
Figure 10. Caustic Treated Styrene/Maleic Di-acid Electrodeposited on Unsized Fibers – 10X
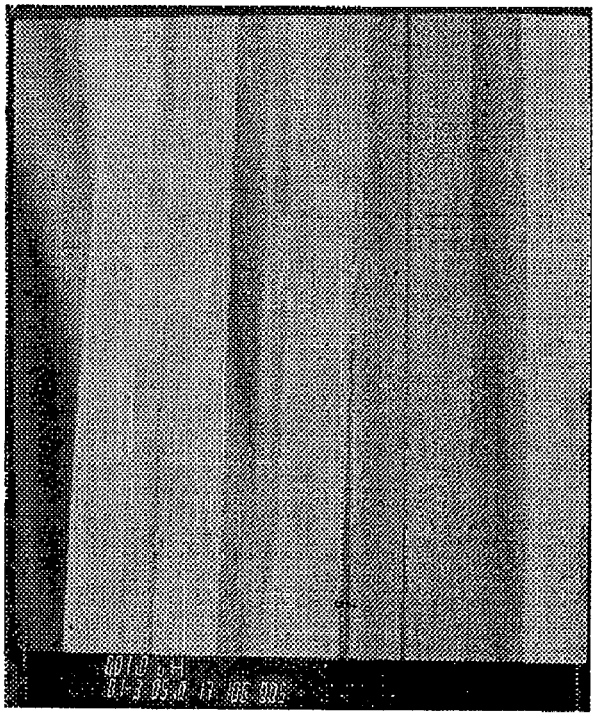
Figure 11. Caustic Treated Styrene Maleic Di-acid Electrodeposited on Unsized Fibers – 1000X

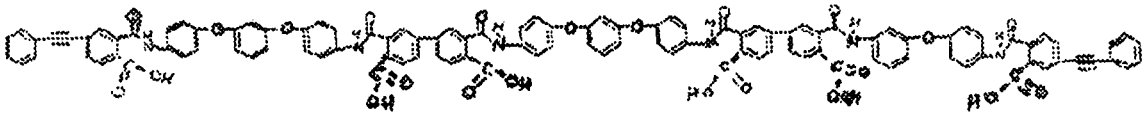
Figure 13. Polyamic Acid Precursor to PETI-298 Polyimide
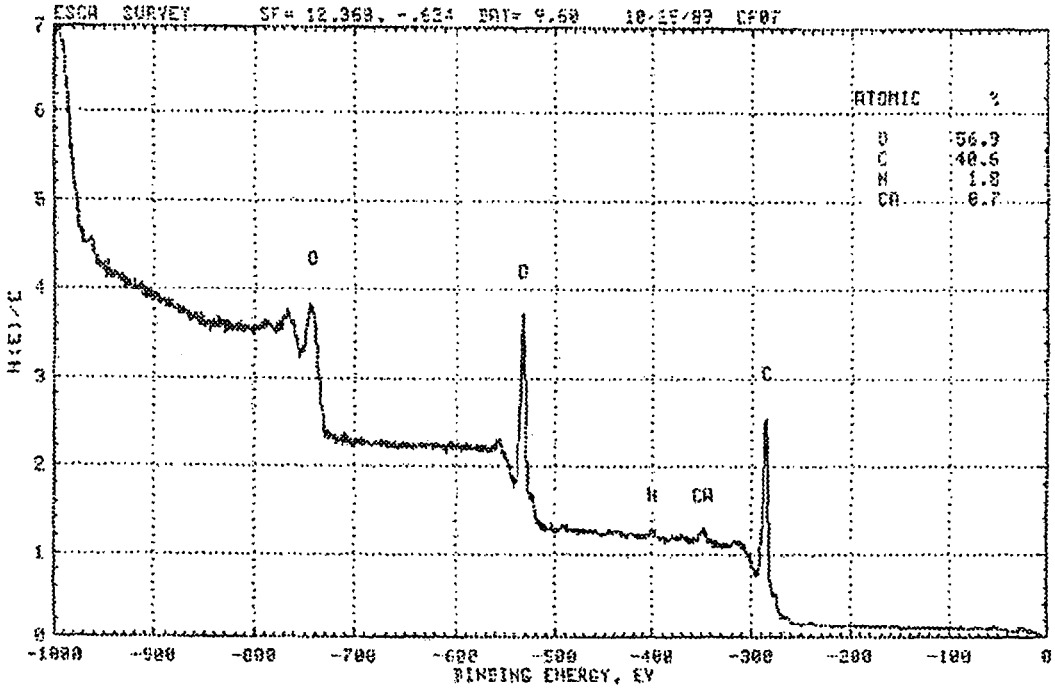
Figure 14. ESCA Survey Spectrum of Carbon Fiber (3 Nitrophthalic Anhydride)

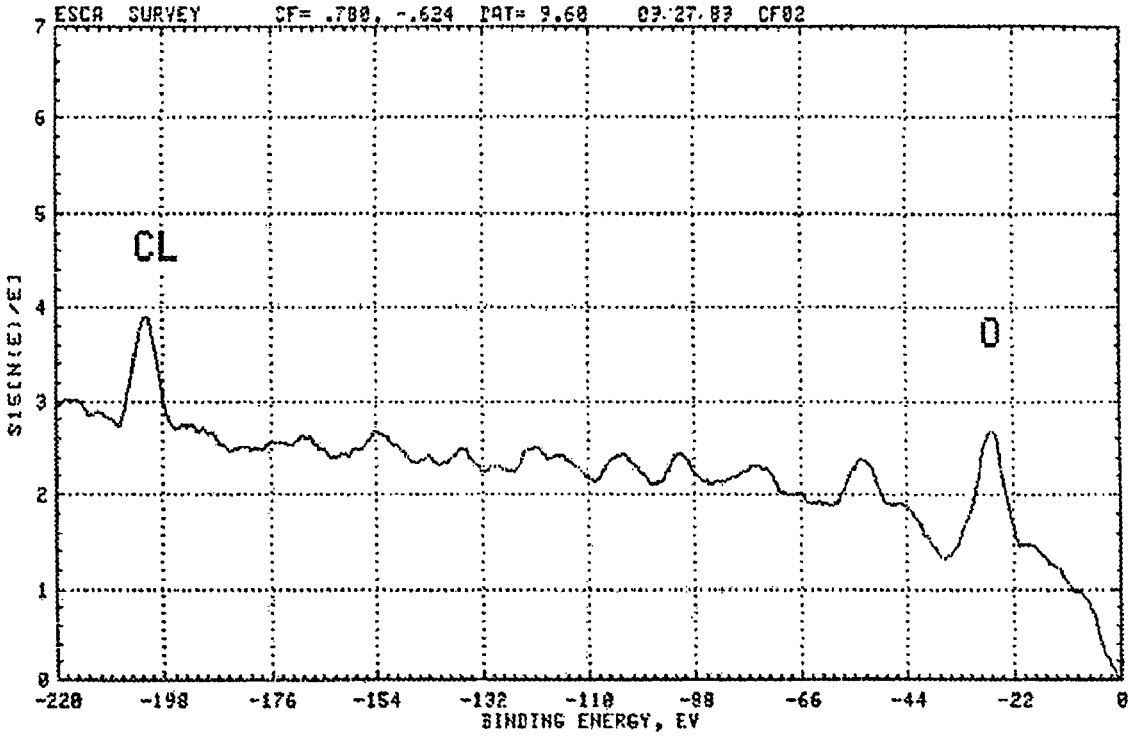
Figure 15. ESCA Spectrum – (Tetrachlorophthalic Anhydride)

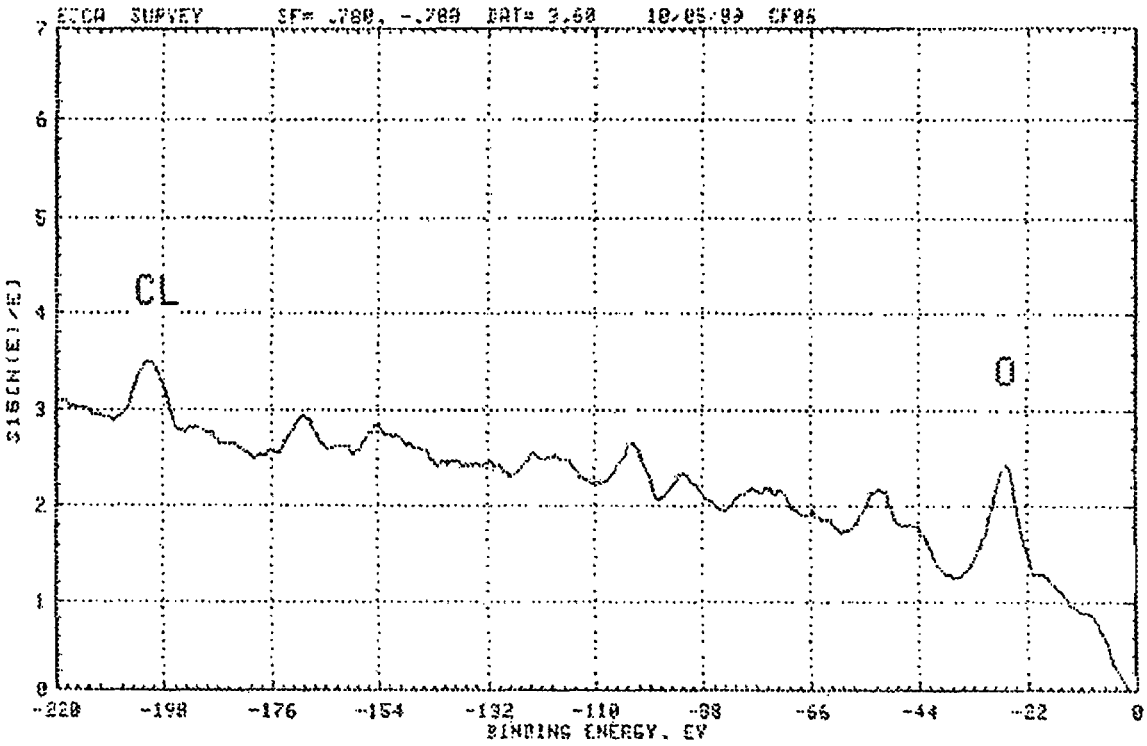
Figure 16. ESCA Spectrum – (Chloro-Maleic Anhydride)

ELECTROCHEMICAL DEPOSITIONS APPLIED TO NANOTECHNOLOGY COMPOSITES

CROSS REFERENCE TO RELATED APPLICATIONS

This application is a divisional of U.S. application Ser. No. 10/676,860, filed Sep. 30, 2003 now U.S. Pat. No. 7,195,701, which is hereby incorporated herein in its entirety by reference.

FIELD OF THE INVENTION

This invention relates to a process known as electrochemical deposition. More particularly, to a process which significantly improves materials without sacrificing the materials' physical and mechanical characteristics; thereby leading to the reduction in an aircrafts structural weight and improvements in performance, and cost reductions in manufacturing.

BACKGROUND OF THE INVENTION

Composite structures, in particular, carbon fiber/resin materials, are rapidly increasing in use, and are of particular interest to the aerospace industry where there is a need for high strength-to-weight structures. A similar need exists in the navy and automobile industry where high-strength/light-weight bodies and other structural parts are being used for possible weight reduction for increased fuel efficiency. The technology involved in producing viable composite materials is quite complex with chemistry, physics and structural mechanics all making a contribution to the composites' properties. However, the overriding feature is the interaction between a carbon (graphite) fiber and a resin matrix at the nanophase level.

In composite laminates, the fiber and resin are essentially a physical blend of two basically dissimilar substances which, in an intimate mixture, result in the formation of a very unique load-carrying material. However, one of the major features in this laminate is the physical, or mechanical, bond that exists between these two dissimilar materials; and in order for the laminate to have any load-carrying capability, it is necessary for the resin to be in close proximity (usually mechanically locked) to the fiber. Thus, carbon/resin composite technology depends on the formation of a strong bond between a fiber substrate and a resin matrix; and the bond interaction parameters are analogous to those found in adhesive bonding processes.

Some of the parameters to be considered, then are: 1) adherend (fiber) surface, e.g., porosity, cleanliness and "wettability" (free-energy of the surface); 2) physical or chemical bonding involved in the adhesion to the fiber; 3) rheological properties of the matrix, e.g., viscosity; and 4) physical and mechanical properties of the substrate and the cured matrix, e.g., shear strength, compression strength, volume change during polymerization of the matrix and thermal coefficients of expansion, among others. Therefore, to optimize the fiber/resin interaction it is necessary to find the best condition for each of these parameters; and, of all of these, the degree to which physical or chemical interactions exist becomes the most critical to be studied. Carbon fibers, when received from the manufacturer, are normally coated with a sizing, e.g., polyvinylalcohol, which is there to keep the fibers from fraying or fuzzing prior to being impregnated with a resin for use in a composite. This sizing is not attached to the fiber, but exists as a sheath around the fiber. There is no chemical bond.

Thus, when a resin is impregnated onto the fiber, the resin does not usually make any chemical bond to the fiber. This lack of a chemical bond is a weak link at the interface between the fiber and the matrix resin. This, in turn, affects the interphase between the fiber/resin interface and the bulk matrix.

A number of references exist that discuss the interactions between a fiber and the binding matrix; and it is claimed that the mechanical characteristics of a fiber/resin composite depend on the properties of the combined materials. Thus, of critical importance are the surface of the fiber, the nature of the fiber-resin bonding, and the mode of stress transfer at the interface. Factors that affect the fiber surface are the various pretreatments the fiber may be subjected to, such as nitric acid oxidation, and other oxidation and pyrolysis treatments. These, in effect, both increase surface area as well as create active sites for enhanced bonding between the fiber and the matrix. However, although various methods have been used to put functional groups on the fiber surface, these "active" sites are statistically sporadic (not completely uniform) on the entire surface. This, in effect, creates isolated sites of attachment and large amounts of resin attach in a discontinuous fashion. Thus, it was shown that by activating the surface of the fiber there was some control of the interface between the fiber and the resin; and, in measuring the failure modes it was found that two types of failure could occur, depending on the interfacial properties.

During the fabrication of a composite, it is essential to convert thousands of square inches of free fiber to a well-wetted, resin coated mixture. However, since the properties of the constituents, themselves, in the course of forming the composite, may be related to a variety of factors, such as, preferential surface adsorption, catalytic effects on the surface, chemical reactions between constituents and differential thermal effects, e.g., shrinkage or expansion, the interface is generally not examined in too great a detail, but, rather, more attention is paid to the interphase. This, not-withstanding, the general opinion is that a weak or strong bond at the interface governs the greater percentage of the properties of the composite.

As a matter of differentiation, therefore, the interface is usually one molecular layer thick, i.e., nanolayer, and the interphase is of macroscopic dimensions (as shown in FIG. 1); and it is the combination of the properties of the material in each phase that determines the behavior of a composite. Thus, it is the surface area and roughness of the reinforcement (fiber), the wetting properties of the matrix, and the differences in thermal and mechanical properties of the constituents that are strongly involved in determining the interaction, bonding and strength of a composite. For example, impregnating a fiber with a resin (either monomer, prepolymer or polymer), and subjecting the mixture to a curing reaction, i.e., polymerization and/or crosslinking, there is generally a shrinkage during the curing process due to a change in volume from a monomer (or prepolymer) to a high molecular weight, crosslinked polymer. And since the resin is not chemically bonded to the fiber, this shrinkage can cause the resin to either pull away from the fiber, either locally (in isolated sites) or totally, leaving a void between the matrix and the fiber; or it can compress onto the fiber and form a compression bond, called "frictional adhesion," and this bond results in a bond strength of about 200 to 1000 lb./sq. in.

Thus, as has been indicated, on all other resin impregnation processes, even when the fiber surface has been activated to allow for some type of chemical bond, there is little or no complete chemical bond to the fiber, and there is no way to control the attachment such that only a nanolayer of resin is attached. It is a bulk, macroscopic process. With the electrodeposition, the process is controlled by time and voltage or amperage. Furthermore, the monomolecular layer of organic (or inorganic) compound (resin) may also function as a sizing that will protect the fiber from fraying or fuzzing. Thus, this process has a two-fold application. The present invention is a solution and a safe new material process application by modifying different resin compositions to create stronger covalent bonding on composite materials thereby creating stronger parts that represent a desired reduction of structural weight.

SUMMARY OF THE INVENTION

This invention provides for a method of improving the material properties of a composite by electrodepositing various polymers, organic compounds or inorganic compounds onto each individual carbon (graphite) fiber strand, whether individual fiber, or as a fabric, to form an homogeneous chemically-bonded composite as opposed to the formation of a heterogeneous, non-chemically bonded composite. Thus, electrodeposition forms a unique discrete interface at the molecular layer (nanolayer) between the reinforcement (fiber) and the matrix (resin) as opposed to any previous resin infusion process. The electrodeposition process allows for the optimization of chemical and physical properties of composite materials by increasing the bond strength between the substrate (fiber) and the matrix (resin).

The process is performed by immersing a carbon (graphite) fiber in an organic compound or polymer, or in an inorganic compound or inorganic polymer having ionizable moieties in the structure of the compound to be electrodeposited. The organic compound comprises an aqueous solution being comprised from the group of polymers, polyamic acid, phenyl phosphinic acid, and or poly isobutylene alt maleic acid, dissolved in an aqueous medium. The inorganic compound aqueous solution being comprised from the group of phenyl boronic acid, and or polysiloxane polymer, with ionizable moieties dissolved in an aqueous medium. The reaction is performed in a glass container electrolysis cell where the carbon (graphite) fiber acts as the anode and a graphite rod acts as a cathode and where the application of an electric potential causes the ionizable moiety to migrate to the anode to create a carbon-carbon (or carbon-inorganic moiety) bond analogous to the Kolbe reaction. In this reaction, a free radical results from the ionizable moiety which couples with the free electron in the charged electrode. When an organic or inorganic material is electrodeposited onto the graphite fiber there is both a change in the interface and the type of bond that exists between the fiber and the organic/inorganic moiety. Moreover, in the first electrodeposited layer which is a monomolecular (nano) layer, a true chemical bond exists of about 80 kcal/mole. This in effect creates a new type of fiber.

This new fiber has different chemical and physical properties from the original fiber. This fiber can now be used to form different composites that would not have been possible with the original fiber. Additionally, almost any other resin can be electrodeposited until there is a large drop in current which indicates a monomolecular layer of resin has been deposited on the fiber and chemically bonded thereto.

To achieve the foregoing and other objects and in accordance with the purpose of the present invention, as embodied and broadly described herein, the process comprises placing the conductive carbon (graphite) into a solution of an ionizable organic/inorganic material to be electrodeposited. Using the carbon (graphite) as the anode in a glass container with a graphite rod as the cathode and impressing a voltage onto the conductive carbon causes the ionic species to migrate to the anode and deposit and bond thereto.

Other features and advantages of the present invention will be apparent from the following description in which the preferred embodiments have been set forth and in conjunction with the accompanying drawings.

BRIEF DESCRIPTION OF THE DRAWINGS

The accompanying drawings, which are incorporated in and form part of the specification, illustrate an embodiment of the present invention and together with the description, serve to explain the principles of the invention. In the drawings:

FIG. 1 shows a fiber-matrix interface/interphase in fibrous composite material;

FIG. 2 shows a schematic of a continuous electrodeposition;

FIG. 3 shows electrodeposition chemical bonding of Carboxymethylcellulose (CMC) onto fiber;

FIG. 4 shows chemical formula for Carboxymethylcellulose;

FIG. 5 shows electrodeposited CMC on fiber at 100.times. magnification;

FIG. 6 shows electrodeposited CMC on fiber at 5000.times. magnification and washed in a NaOH solution;

FIG. 7 shows electrodeposited CMC on fiber at 1000.times. magnification embedded in epoxy and fractured;

FIG. 8 shows Styrene/Maleic Di-acid electrodeposited on unsized fibers at 10.times. magnification;

FIG. 9 shows Styrene/Maleic Di-acid electrodeposited on unsized fibers at 1000.times. magnification;

FIG. 10 shows caustic treated Styrene/Maleic Di-acid electrodeposited on unsized fibers at 10.times. magnification;

FIG. 11 shows caustic treated Styrene/Maleic Di-acid electrodeposited on unsized fibers at 1000.times. magnification;

FIG. 12 shows a generalized Structure of DX-16

FIG. 14 shows an FIG. 13 shows Polyamic Acid Precursor to PETI-298 Polyimide. ESCA survey spectrum of carbon fiber (3 Nitrophthalic Anhydride);

FIG. 15 shows an ESCA spectrum (Tetrachlorophthalic Anhydride); and

FIG. 16 shows an ESCA spectrum (Chloro-Maleic Anhydride);

DETAILED DESCRIPTION OF THE INVENTION

In the electrodeposition onto a carbon fiber, the organic polymer and the carbon fiber are both carbonaceous. Therefore, once the process is initiated, the chemistry is allowed to progress through the intermediate stages. The result is a true covalent bond. Bonding of an interface, i.e., between a substrate (fiber) and a matrix (resin), can occur in a number of ways. A mechanical interaction is that in which an interlocking of two components develops by having one substance fill the pores in a substrate. It is well-accepted, however, that if one wishes to have a shear force at least as strong as the constituent materials, it is necessary to develop some kind of chemical bonding; and chemical bonding can be classified as primary with it being either ionic or covalent, and the bond energies between atoms would be on the order of about 80-100 Kcal/g-mole, with bond distances being about 1-3.ANG., i.e., monomolecular or nanolayer. This leads to theoretical bond strengths of about 106 to 10.sup.7 lb./sq. in.

The covalent bond is a true sharing of the electron orbitals such that the outer shell electrons of each contributing specie to the bond loses its identity and forms molecular orbitals that bind the nuclei of the interacting atoms. This manifests itself as a high electron density along the internuclear axis, and it is this type of bonding that would be expected to occur in the electrodeposition of an organic compound onto the carbon (graphite) fiber with a bond energy of about 80-100 Kcal/g-mole. Based upon the chemistry of the Kolbe reaction, a carboxylate ion (RCOO.sup.crclbar.) or any other anion, e.g., RO.sup.crclbar., RSOO.sup.crclbar., RSO.sub.2O.sup.crclbar., RPO.sub.3.sup.crclbar.or RS.sup.crclbar., will give up an electron to the positively-charged anode to form a carboxylate (RCOO.), RO., RSOO., RS.sub.2O., RPO.sub.3. or RS. radical which will split out CO.sub.2 (in the case of the carboxylate radical) to leave an alkyl or aryl radical (R.), where R is any alkyl, aryl, cycloalkyl or heterocyclic radical. This radical will chemically attach to the carbon (graphite) fiber and form a true carbon-carbon covalent bond. Similarly, the RO., RSOO., RSO.sub.3., RPO.sub.3. or RS. will also attach to the fiber and form an ether or thioether bond. Alternatively, the RO. or RS. can split out O.sub.2 or S.sub.2 and form a carbon-carbon bond. In the case of RSOO., RSO.sub.3., or RPO.sub.3., SO.sub.2, SO.sub.3 or O.sub.2 can split out. This will result in a nanolayer of organic compound (polymer) onto the carbon (graphite) fiber, and, at this point, the organic layer is a resistance layer with no further chemical bonding possible. However, an electric (electrostatic) field still exists around the fiber and the charged anions in solution will continue to migrate and deposit onto the already-coated fiber and build up further layers of the organic coating until, at constant voltage, the layer is so thick that the field effect is lost and the current drops to zero. Thus, time and voltage can be the critical determining factors with regard to the formation of a nanolayer. However, since the excess coating is, essentially, the same chemical structure as the original polymer or compound (prior to its conversion to a free radical), it can be removed by washing with an aqueous ionic solution, e.g., sodium hydroxide or ammonium hydroxide, among others. At which point only the nanolayer is left intact on the substrate.

Referring to FIG. 2, which is a continuous process for electrodeposition, take a polymer, e.g., polyamic acid, or ionizable organic compound, dissolved in an aqueous medium (preferred) (1), contained in a glass or other non-conducting container (2), with electrodes inserted and connected to a direct current source (3), and a carbon (graphite) fiber or cloth (4). Combine the solution (1) and the carbon (graphite) substrate (4) in the glass container (2). Attach one power lead (5) to a graphite rod, which is the cathode and the other lead (6) to the carbon (graphite) cloth or fiber (4) as the anode. Apply an electric potential to cause the ionized chemicals to flow to the anodic substrate and bond thereon. Finally, a water or alkaline solution rinse (7) removes any excess chemicals from the substrate.

In the electrodeposition onto a carbon fiber, the organic polymer and the carbon fiber are both carbonaceous and once the process is initiated and the chemistry can progress through the necessary intermediate stages, the result can be, and usually is, a true carbon-carbon covalent bond with its consequential stability and high bond strength, e.g., about 80 kcal/mole. Essentially, the technique of electrodeposition consists of using a graphite (carbon) fiber as one electrode (anode) in an electrolysis cell with the cathode being any metal or graphite rod, and the electrodeposition onto the carbon fibers is via the Kolbe reaction. In the case of a carbon fiber and a polymeric acid, where there is a multiplicity of functional acidic groups along the polymer chain, the resin can bond to the fiber in a multiplicity of sites, as schematically shown in FIG. 3. FIG. 3 shows the attachment of multiple sites to the carbon (graphite) fiber using the ammonium salt of carboxymethylcellulose (CMC) (Hercules Powder Co.) as the polymer. FIG. 4 depicts the general formula for carboxymethylcellulose. Alternatively, one can use a sulfonic or sulfinic, phosphoric or phosphonic, mercaptyl or other anionic acidic specie. Using carboxymethylcellulose (CMC) as a test polymer, it was electrodeposited onto carbon fiber and then washed with water (in which CMC is very soluble), it was found that a large amount of resin remained attached to the fiber, as seen in FIG. 5, which is a scanning electron microscope (SEM), 100.times.picture of the treated fiber. Further analysis was done via Fourier Transform Infrared (FTIR) spectroscopy. It showed the presence of the cellulose hydroxyls. Subsequently, a sodium hydroxide wash was done and 5000.times.SEM picture (FIG. 6) shows almost everything removed, but the FTIR still showed the presence of the cellulose hydroxyls. By comparison, when the fiber was dipped into the CMC solution for the same period as the electrodeposition process, and then subjected to an aqueous wash, there was absolutely no evidence of any CMC on the fiber. The SEM and FTIR looked the same as an untreated fiber.

Further tests were performed to show that this nanomolecular layer of resin does form a true chemical bond from the fiber to any resin matrix. For this, the fiber with CMC attached to it was bonded with an epoxy resin and an interlaminar shear test was run. The sample did not fail in shear, but in tension. This indicated that a strong bond existed between the fiber and the resin and the sample snapped in tension. Another test that was run was to have the CMC-coated fiber embedded in an epoxy resin, cured and then fractured in liquid nitrogen. FIG. 7 is a 1000.times.SEM picture of the composite after being fractured. Similar results were obtained when the CMC-coated fiber was first treated with either succinic anhydride or maleic anhydride and then embedded in an epoxy resin. In these instances, the fractured samples also showed that the epoxy was bonded to the anhydride-treated CMC fiber and that the matrix was held onto the fiber while for a non-electrodeposited sample there was separation between the fiber and the matrix.

The bonding in electrodeposition takes place because the resultant free radical on the polymer chain can couple with a free electron in the charged electrode. Alternatively, the initially formed carboxylate anion (COO—) can attach to the carbon fiber anode via a charge neutralization process. Hence, by the proper choice of resin, electrode polarity and voltage, one can expect to have a strongly bonded (chemical bond) resin at the interface between the fiber and the polymeric resin at the nanomolecular level. This resin or any other resin with the proper functional groups in its make up, can also be a good interphase between the fiber and the matrix resin.

One of the novel aspects of this invention rests in the fact that the electrodeposited coating is a nanolayer of material that controls the resultant properties of the composite. By contrast, when a resin is impregnated onto the fiber via resin film infusion, or any other impregnating technique, the resin does not usually make any chemical bond to the fiber. This lack of a chemical bond is a weak link at the interface between the fiber and the matrix resin. This in turn, affects the interphase between the fiber/resin interface and the bulk matrix. However, since the toughness of a composite is measured by the resistance of the material to crack growth and propagation, the interface can affect the toughness of a composite by providing various energy absorbing mechanisms, like debonding, fiber stress relaxation and fiber pullout during fracture. The electrodeposited coating, with its ability to chemically bond to the substrate, is better able to enhance the toughness. Thus, since the debonding as well as the energy absorbed due to the debonding process, depends largely upon the interfacial bond strength, the nanolayer attached to the fiber is critical to the resultant properties of the composite.

As shown in example 1, the essential feature in the electrodeposition is that the depositing compound be made soluble in water or water/organic solvent mixture. Additionally, it is capable of forming a salt with a basic substance, such as, sodium hydroxide, ammonium hydroxide, an amine, e.g., triethylamine, pyridine, dimethylaniline, or other basic substance. Voltage (d.c.) and time govern the thickness of the coating.

EXAMPLE 1

A 15 percent solution of carboxymethylcellulose (CMC) is prepared by dissolving 15 grams of CMC (0.07 moles) in 85 mls of deionized water in a stainless steel container. To this is added 0.07 moles of 28 percent ammonium hydroxide (8.7 grams). With the carbon (graphite) cloth or fiber (onto which the CMC will be electrodeposited) as the anode in an electrolytic cell and the stainless steel container as the cathode, the electrolysis is begun by adjusting the d.c. voltage and measuring the drop in current (amperes) with time. When the amperes are close to zero (or some other arbitrary low value), the electrodeposition is stopped. The substrate (cloth or fiber) is removed, washed with water and/or sodium hydroxide or ammonium hydroxide or triethylamine (or any other basic material), followed by a water wash to remove the base and dried for subsequent use in preparing a carbon/resin composite. Alternatively, the treated substrate can be removed from the electrodeposition solution, dried and used as such for preparing a composite. By way of example, the following current/voltage/time data typifies the electrodeposition process. Table 1 shows the drop in current for a 20 volt (d.c.) electrodeposition. Voltages used have been from five (5) volts to 150; and times have been from 15 seconds to 20 minutes, depending upon how much organic coating is wanted.

EXAMPLE 2

Following the procedure of Example 1, 15 grams of polystyrene/maleic anhydride alternating copolymer which had been hydrolyzed to the diacid, viz., styrene/maleic acid (0.07 moles), was dissolved in 85 mls of water and treated with two molar equivalents of ammonium hydroxide (for the dibasic acid in the copolymer), i.e., 17.4 grams of a 28 percent ammonium hydroxide solution. The electrodeposition was performed as shown in Example 1 and washed with water. The resultant product was examined via SEM and FIG. 8 shows a 10.times. magnification, while FIG. 9 shows a 1000.times. magnification. After a caustic (NaOH) wash, the fibers looked as shown in FIG. 10 (a 10.times. magnification) and FIG. 11 for a 1000.times. magnification.

EXAMPLE 3

This example demonstrates the possibility of performing the electrodeposition in a mixture of organic solvent and aqueous solution. Using a compound known as Shell DX-16 (FIG. 12) (Shell Chemical Co., Emeryville, Calif.) which was dissolved in N-methylpyrrolidone (NMP) to a 50 percent concentration and then made as a 15 percent solution in deionized water (resulting in a mixture of water and NMP) and neutralizing this with 28 percent ammonium hydroxide, an electrodeposition was performed on Thornel 50 fiber at 20 volts. The current dropped from 952 amperes to 65 amperes in 3.5 minutes. Thus, indicating the deposition of a coating as the fiber became coated with an insulator.

EXAMPLE 4

A polyamic acid precursor to a polyimide (PETI-298) (supplied by Eikos Chemical Co., Franklin, Mass.) was synthesized, as shown in the schematic of FIG. 13. This polyamic acid (dissolved in NMP as a 50% solution) was neutralized with ammonium hydroxide and diluted to a 15% solution in water and electrodeposited onto AS-4 carbon tape at 100 volts. The resultant product was washed with water, dried and pyrolyzed at 1000.degree. C. (under nitrogen) to result in a carbon-carbon composite. This demonstrates the feasibility of obtaining a carbon-carbon composite from an electrodeposited coating.

EXAMPLE 5

In another series of tests to show the effect of electrodepositing the CMC onto the carbon (graphite) fiber (not shown), a determination was made of the work function of the electrodeposited fiber. If the polymer was physically or mechanically held onto the fiber, the electrical conductance should not be affected. If, however, it was chemically bonded, some change should result in the electrical conductance. In particular, if one were to attach electropositive or electronegative moieties to the polymer, and if some electronic or inductive effect should be operating, then the conductance could be made to change accordingly. Thus, if after electrodepositing the CMC onto the carbon (graphite) fiber the resultant product was then allowed to react with a number of anhydrides to effect an ester formation on the CMC hydroxyls, some change in the conductance should be noted. With an electron-withdrawing anhydride, e.g., 4-nitrophthalic anhydride or 3-nitrophthalic anhydride, the conductance decreased. With an electron-donating anhydride, e.g., tetrachlorophthalic anhydride or chloromaleic anhydride, the conductance increased. These data are summarized in Table 2 where the values of conductance are given for the carbon fiber prior to electrodepositing the CMC, then for the conductance with the CMC (after removing all but the nanolayer) and then for the CMC-coated fiber after reacting with the anhydride. Furthermore, the Electron Spectroscopy for Chemical Analysis (ESCA) spectra show that the nitroanhydrides and chloroanhydrides had reacted with the hydroxyls on the CMC, as evidenced by the presence of the nitrogen and chlorine in the spectra (shown in FIGS. 14, 15, and 16, respectively). This was good proof that the CMC was chemically bound to the fiber and that the electronic and inductive effects of the anhydride could be transmitted to the fiber.

The foregoing description of the preferred embodiment of the invention has been presented for purposes of illustration and description. It is not intended to be exhaustive or to limit the invention to the precise form disclosed, and obviously many modifications and variations are possible in light of the above teaching.

TABLE 2

Electrical Conductance of Anhydride-Treated CMC-Coated Fibers

| Sample | Carbon Conductance Before Electrodeposition | CMC-Coated Fiber | Anhydride-CMC |
|---|---|---|---|
| 4-Nitrophthalic Anhydride | 640 MA | 651 MA | 580 MA |
| 3-Nitrophthalic Anhydride | 642 MA | 650 MA | 585 MA |

TABLE 2-continued

Electrical Conductance of Anhydride-Treated CMC-Coated Fibers

| Sample | Carbon Conductance Before Electrodeposition | CMC-Coated Fiber | Anhydride-CMC |
|---|---|---|---|
| Tetrachlorophthalic Anhydride | 639 MA | 626 MA | 652 MA |
| Chloromaleic Anhydride | 639 MA | 615 MA | 640 MA |

TABLE 1

Electrodeposition of CMC onto Six Inches Carbon Fiber

| Time | Current | Voltage (d.c.) |
|---|---|---|
| 0 | 1210 | 20 |
| :15 | 1028 | 20 |
| :30 | 812 | 20 |
| 1:00 | 411 | 20 |
| 2:00 | 91 | 20 |
| 3:00 | 71 | 20 |

What is claimed is:

1. A composite article comprising a carbon fiber or carbon fiber cloth having an outer polymeric nanomolecular layer covalently bonded thereto, the polymeric nanomolecular layer comprising an organic compound selected from the group consisting of carboxymethylcellulose, phenyl phosphinic acid, phenyl boronic acid, poly isobutylene alt maleic acid, and combinations thereof.

2. The composite article of claim 1, wherein the polymeric nanomolecular layer has a thickness on the order of one molecular layer of said organic compound.

3. The composite article of claim 1, wherein the carbon fiber or carbon fiber cloth is embedded into a cured resin matrix.

4. A composite article comprising a carbon fiber or carbon fiber cloth having an outer polymeric nanomolecular layer covalently bonded thereto, the polymeric nanomolecular layer comprising carboxymethylcellulose.

5. The composite article of claim 4, wherein the carbon fiber or carbon fiber cloth is embedded into a cured resin matrix.

6. An article having a nanomolecular resin layer covalently bonded thereon formed by a. providing an aqueous solution comprising an organic compound contained in a non-conducting container;

b. connecting a direct current source to a carbon fiber;

c. providing a graphite rod;

d. combining the fiber, the aqueous solution, and the graphite rod in the non-conducting container with a basic substance;

e. attaching a first power lead of the direct current source to the graphite rod which acts as the cathode, and a second power lead to the carbon fiber as the anode to ionize the aqueous solution; and f. applying an electric potential from said direct current source to cause the ionized aqueous solution to flow to an anodic substrate; and g. creating a nanomolecular layer comprising the organic compound that is covalently bonded to said carbon fiber, wherein the organic compound comprises carboxymethylcellulose, phenyl phosphinic acid, phenyl boronic acid, poly isobutylene alt maleic acid, or combinations thereof.

7. The article of claim 6, wherein the basic substance comprises sodium hydroxide, ammonium hydroxide, or triethylamine.

8. The article of claim 6, wherein the process of forming the article further comprises the step of washing excess organic compound from the nanomolecular layer to leave an organic nanolayer that is covalently bonded to said carbon fiber.

9. The composite article of claim 6, wherein the carbon fiber is embedded into a cured resin matrix.

10. An article having a nanomolecular resin layer covalently bonded thereon formed by connecting an anodic lead of a direct current source to a carbon fiber or carbon cloth;

advancing the carbon fiber or carbon cloth through a first bath in a continuous manner, the first bath comprising an aqueous solution of an organic compound or inorganic compound, a basic substance, and a graphite rod that is connected to a cathodic lead of the direct current source;

passing an electric current from said graphite rod to said carbon fiber or carbon cloth;

electrodepositing a nanomolecular layer comprising the organic or inorganic compound on the carbon fiber or carbon cloth as it is being advanced through the first bath; and advancing the carbon fiber or carbon cloth having a nanomolecular layer through a second bath in a continuous manner, the second bath comprising a water or alkaline solution that removes excess chemicals from the nanomolecular layer, and wherein the organic or inorganic compound comprises carboxymethylcellulose, phenyl phosphinic acid, phenyl boronic acid, poly isobutylene alt maleic acid, polysiloxane, or combinations thereof.

11. The process of claim 10, wherein the second bath comprises a basic solution.

12. The process of claim 10, wherein the second bath comprises sodium hydroxide, ammonium hydroxide, or triethylamine.

13. The article of claim 10, wherein the organic compound comprises a polysiloxane polymer.

14. An article having a nanomolecular resin layer covalently bonded thereon formed by a. providing an aqueous solution comprising an organic compound contained in a non-conducting container;

b. connecting a direct current source to a carbon fiber;

c. providing a graphite rod;

d. combining the fiber, the aqueous solution, and the graphite rod in the non-conducting container with a basic substance;

e. attaching a first power lead of the direct current source to the graphite rod which acts as the cathode, and a second power lead to the carbon fiber as the anode to ionize the aqueous solution; and f. applying an electric potential from said direct current source to cause the ionized aqueous solution to flow to an anodic substrate; and g. creating a nanomolecular layer comprising carboxymethylcellulose covalently bonded to said carbon fiber.

15. The composite article of claim 14, wherein the carbon fiber is embedded into a cured resin matrix.

16. An article having a nanomolecular resin layer covalently bonded thereon formed by connecting an anodic lead of a direct current source to a carbon fiber or carbon cloth;

advancing the carbon fiber or carbon cloth through a first bath in a continuous manner, the first bath comprising an aqueous solution of an organic compound, a basic substance, and a graphite rod that is connected to a cathodic lead of the direct current source;

passing an electric current from said graphite rod to said carbon fiber or carbon cloth;

electrodepositing a nanomolecular layer comprising carboxymethylcellulose on the carbon fiber or carbon cloth as it is being advanced through the first bath; and advancing the carbon fiber or carbon cloth having a nanomolecular layer through a second bath in a continuous manner, the second bath comprising a water or alkaline solution that removes excess chemicals from the nanomolecular layer.

* * * * *